US006006562A

United States Patent [19]

Wolter

[11] Patent Number: 6,006,562

[45] Date of Patent: Dec. 28, 1999

[54] COLLECTOR HOLDER, PARTICULARLY FOR KEYS

[76] Inventor: Heinz Wolter, Meiswinkel 3, D-51515 Kürten, Germany

[21] Appl. No.: 09/205,148

[22] Filed: Dec. 3, 1998

[30] Foreign Application Priority Data

Dec. 6, 1997 [DE] Germany ..... 197 54 194

[51] Int. Cl.[6] ..... A47G 29/10

[52] U.S. Cl. ..... 70/456 R; 70/459; 362/116

[58] Field of Search ..... 70/456 R, 456 B, 70/459, 460; 206/38.1, 37.1, 37.4, 37.5, 37.6, 37.7, 37.8; 362/100, 116

[56] References Cited

U.S. PATENT DOCUMENTS

| | | | |
|---|---|---|---|
| 1,914,318 | 6/1933 | Yankovitch | 70/456 R |
| 1,974,547 | 9/1934 | Slade | 70/456 R |
| 2,136,199 | 11/1938 | Swanson | 206/38.1 |
| 2,640,347 | 6/1953 | Majeski | 70/456 R |
| 2,708,073 | 5/1955 | Mohylowski | 70/456 R X |
| 3,630,212 | 12/1971 | Mosch | 70/456 R X |
| 5,154,073 | 10/1992 | Huang | 70/459 X |
| 5,228,563 | 7/1993 | Stringham | 206/38.1 |
| 5,463,539 | 10/1995 | Vandenbelt et al. | 362/116 X |
| 5,487,291 | 1/1996 | Voigt | 70/456 R |

FOREIGN PATENT DOCUMENTS

| | | | |
|---|---|---|---|
| 0099444 | 2/1984 | European Pat. Off. . | |
| 1227982 | 8/1960 | France | 362/116 |
| 2609304 | 7/1988 | France | 70/456 R |
| 2073012 | 10/1981 | United Kingdom | 362/116 |

*Primary Examiner*—Lloyd A. Gall
*Attorney, Agent, or Firm*—Martin A. Farber

[57] ABSTRACT

A collective holder, in particular for keys, having a holder housing (1) of flat configuration with a cornerless outline whose circumferential narrow side wall forms a running rail (2) with a removal opening, operable by a grip from a broad side wall, for runners (3) captured in the running rail (2). The collective holder provides an outline contour deviating from the circular and has two opposite, approximately semicircular arc segments (A, B) whose apexes (A', B') are spaced apart by approximately the width of two fingers, and whose broad side wall opposite the grip accommodates a luminaire (incandescent lamp 17) which points in the direction of the apex (A'), shines over the movement path of the runners (3) and can be activated by a pushbutton (24) arranged on the broad side wall.

48 Claims, 4 Drawing Sheets

COLLECTOR HOLDER, PARTICULARLY FOR KEYS

FIELD AND BACKGROUND OF THE INVENTION

The invention relates to a collective holder, in particular for keys, having a holder housing of flat configuration with a cornerless outline whose circumferential narrow side wall forms a running rail with a removal opening, operable by means of a grip from a broad side wall, for runners captured in the running rail.

A collective holder of the type under discussion is known from EP 0 099 444 B1, the holder housing having a circular plan with a diameter approximately of the size of a key grip of a flat key. Guided in the diametral of the holder housing is a grip which can be operated from one broad side wall and, upon being displaced, releases a removal opening in order to be able to remove or insert a runner of the running rail.

SUMMARY OF THE INVENTION

It is the object of the invention to improve a collective holder of the introductory-mentioned type in terms of operation.

This object is achieved firstly and essentially, on the one hand, with a collective holder having the features of the invention, the aim being to provide an outline contour deviating from the circular and having two opposite, approximately semicircular arc segments whose apexes are spaced apart by approximately the width of two fingers, and whose broad side wall opposite the grip accomrodates a luminaire which points in the direction of the apex, shines over the movement path of the sliders and can be activated by means of a pushbutton arranged on the broad side wall. On the other hand, the object of the invention is achieved with a collective holder of the introductory-mentioned type by virtue of the fact that an outline contour deviating From the circular and having two opposite, approximately semicircular arc segments is provided whose apexes are spaced apart by approximately the width of two fingers, and whose radii of curvature differ from one another approximately by a factor of two, the grip being situated approximately in the region of the midpoint of the arc segment with the largest radius, and the removal opening being situated at the apex of this arc segment.

Such an embodiment provides a collective holder of the type under discussion which is distinguished by an enhanced use value. This relates, in particular, to the operation of the collective holder. By contrast with the known embodiment, the latter can be held with the support of three fingers. This is done by supporting the index and middle fingers on one broad side wall while the thumb is supported on the opposite broad side wall. It is possible by means of single-handed operation to actuate both the pushbutton situated on one broad side wall and the grip arranged on the other broad side wall, for the purpose of removing or adding one or more runners. The other hand is thereby free to find and grip the key held by the sliders. Consequently, this process can be carried out at short notice by means of the luminaire pointing in the direction of the apex, which is provided on the broad side wall and shines over the movement path of the sliders. Furthermore, the luminaire eases the insertion of the key into the keyhole under conditions of poor visibility and of darkness. Considerable advantages in terms of operation still result even if a luminaire on one broad side wall is dispensed with. Because of the ergonomic configuration of the holder housing, it is always gripped in a directionally oriented fashion as a result of the three-finger support. Because of this flat ovoid shape, gripping of the holder housing is directed to the effect that the thumb is supported in the region of the apex with the smallest curvature, that is to say approximately in the region of the midpoint of the arc segment with the largest radius, while the index and middle fingers can be supported on the opposite broad side wall in the corresponding alignment. Thus, when the collective holder is gripped this midpoint constitutes in some regard a fulcrum in association with the fact that the runners move with the keys located on them into the region of the largest curvature, that is to say to where the smaller radius of curvature is situated. Consequently, with this kind of gripping the runners are held with the keys fixed on them in the inset of he hand resulting when they are gripped. To remove a runner with associated key, the corresponding runner is to be displaced into the region of the arc segment with the largest radius, where the removal opening is also located. This is where, because of the smallest curvature, the greatest mobility for the runner is provided, and this eases the removal and/or addition of a runner. It proves in this case to be favorable for gripping to provide broad side elevations which are arranged on both sides of the running rail holder and overlap the latter. The apexes of the broad side elevations are likewise situated in the region of the midpoint of the arc segment with the largest radius of curvature. This configuration produces a pressed-flat ovoid shape, with the result that an ovoid shape of the collective holder is present not only in plan. The broad side elevation opposite the grip can then contain a recessed emblem which can, for example, be designed as a company logo or the like. The directionally oriented grasping of the holder housing is also aided given the arrangement of a luminaire by the alignment of the latter, which points in the direction of the apex with the largest radius of curvature. The beam direction of the luminaire therefore runs approximately in the extension of the thumb, which optimizes the use of the collective holder as luminaire. The arrangement of the removal opening in the region of the light beam does justice to this state of affairs. In the case of poor visibility conditions, and also of darkness, it is still possible to remove or add runners with ease. In addition, providing the removal opening in the region of the light beam has the favorable effect that the removal side is formed by the arc segment with the largest radius of curvature, and so the runner can always move through this region unimpeded. It is then to be stressed that the operating grip is part of a slider. The direction of displacement extends in the longitudinal direction of the ovoid holder housing. The operating grip is preferably provided in the region of the arc segment with the largest radius of curvature, that is to say where the thumb is supported on the holder housing. The sliders enjoy a secure hold by virtue of the fact that they have a hemispherical head, guided in the U-profiled rail. It is to be stressed, furthermore, that the luminaire is embedded in a luminaire housing fastened on the broad side of the holder housing. In detail, this means that the luminaire housing is connected by screws to the bipartite running rail holder, and the screw thread is formed by a central threaded cavity of at least one screw connecting the two half running rail holders to one another. This measure permits the luminaire housing to be easily attached, and also removed, without the need to dismantle the bipartite running rail holder. It is then favorable that the pushbutton is formed by a thin-walled, deflectable luminaire housing section. As a result, the interior of the luminaire housing is largely protected and so, therefore, are the electric components accommodated in the interior. A minimum of electric components is realized by virtue of the fact that a metal running rail holder forms the contact bridge between the battery and incandescent lamp. The circuit to the incandescent lamp is closed in this case by a contact tongue which can be displaced against a large-surface contact of the battery by means of the pushbiutton. It is therefore not necessary to support the battery via a compression spring. Again, when the circuit is closed the battery, which is configured as a button cell battery, experiences no displacement. The contact tongue is the end section of a compression spring in this case. This means that the lamp foot contact is always reliably connected to the contact tongue even if tolerances arise in the contact foot during production of the incandescent lamp. The beam direction of the luminaire is provided by virtue of the fact that the beam of the incandescent lamp is directed by means of a cylindrical stop. The latter is formed, in a way which is simple in terms of production engineering, both by the luminaire housing and by the facing running rail holder. A further advantageous feature of the invention is to be seen in that the slider is guided linearly, with the result that when being displaced by the index finger the operating grip never leaves its alignment with the surface of the index finger. In the interest of holding the luminaire housing reliably and in a protected fashion, it is provided that the luminaire housing is wall-mounted by a rear edge of the running rail. Finally, it remains to mention the eccentric arrangement of the pushbutton, to the effect that the pushbutton is adjacent to the apex with the strongest curvature. On the one hand, this is advantageous from a design point of view since the pushbutton extends in a fashion adjoining the incandescent lamp. On the other hand, in the case of three-finger support of the holder housing, the thumb, which faces the apex with the strongest curvature, can operate the pushbutton located there. A sufficiently large displacement path for the contact tongue is realized without increasing the overall height of the collective holder by virtue of the fact that on its broad surface facing the luminaire housing, the half running rail holder has a depression which is intended to partially accommodate the button cell battery. Particularly favorable contact is made between the button cell battery and the incandescent lamp base when the half running rail holder having the depression and in conductive electric connection with the luminaire is produced from metal.

BRIEF DESCRIPTION OF THE DRAWINGS

With the above and other objects and other advantages in view, the present invention will become more clearly understood in connection with the detailed description of preferred embodiments, when considered with the accompanying drawings of which

DETAILED DESCRIPTION OF THE PREFERRED EMBODIMENTS

Figures 1, 2, 3, 4, 5:
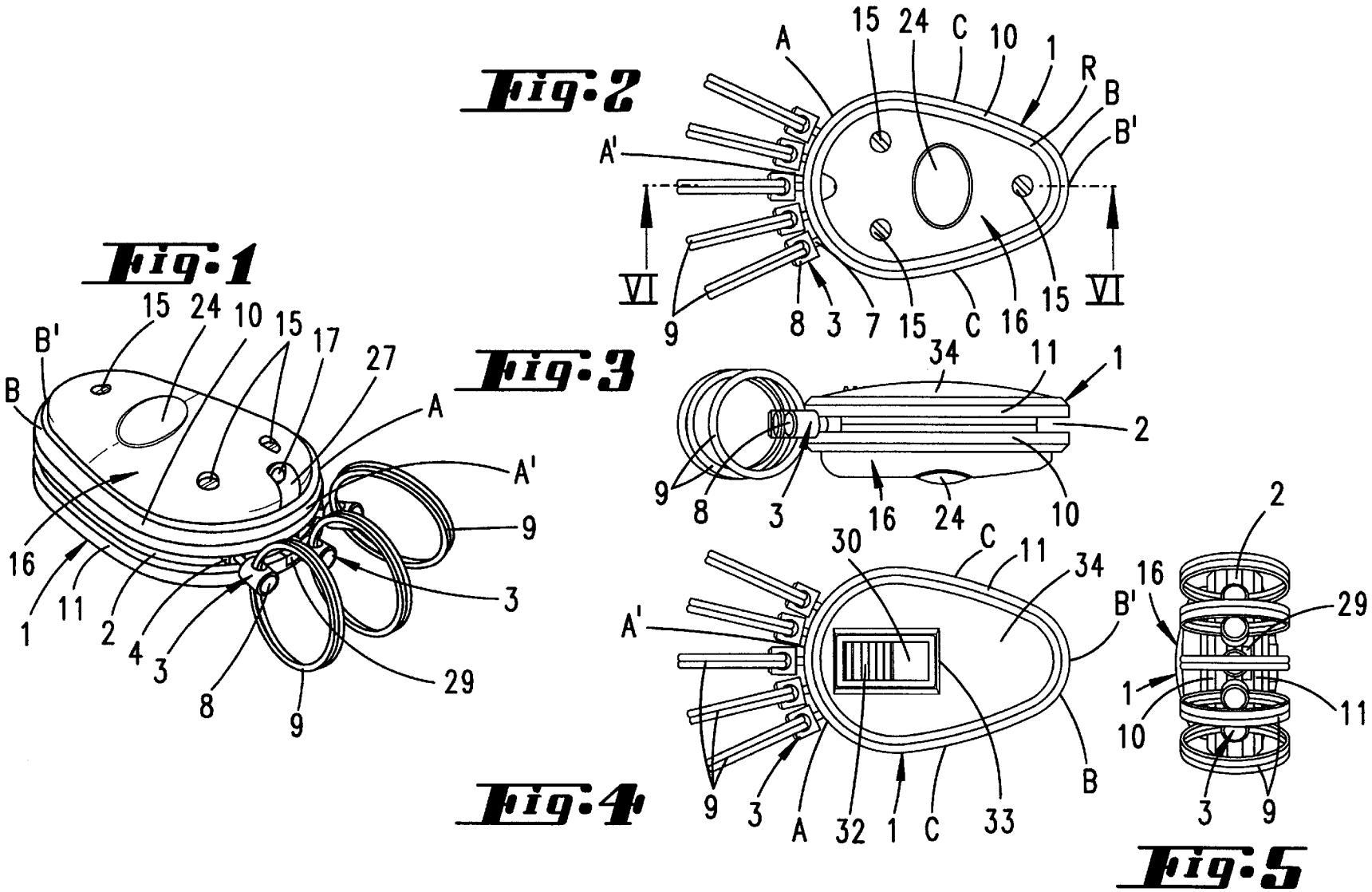
FIG. 1 shows a perspective representation of the collective holder according to the invention, relating to the first embodiment.
FIG. 2 shows a view of the collective holder looking towards the broad side wall provided with the luminairle housing.
FIG. 3 shows a representation of FIG. 2, turned through 180°.
FIG. 4 shows a rear view of FIG. 2.
FIG. 5 shows a representation of FIG. 4, turned through 180°.

The collective holder represented is particularly suitable for keys. It has a holder housing 1 of flat configuration with an ovoid outline contour. The circumferential narrow side wall of this holder housing 1 forms a running rail 2 for accommodating runners 3. Each runner 3 has a hemispherical head 4 which is guided in the U-profiled running rail while forming a supporting shoulder 4' aligned at right angles to the longitudinal extent of the slider 3. Said shoulder is supported on mutually facing, inwardly directed outer edges 5, 6 of the U-profile of the running rail 2. Projecting beyond the supporting shoulder 4' is a round web 7, which is of smaller cross section than the head 4 and merges by forming a step into a knob 8 of larger cross section. Said knob is the holder of a key ring 9.

Because of the ovoid outline contour, the holder housing 1 has opposite, approximately semicircular arc segments A, B whose apexes A', B' are spaced apart by approximately the width of two fingers in such a way that the apex A' has a larger radius of curvature than the apex B'. The arc segments A, B are connected with a stepless transition by identical arc segments C of shallow curvature. The radii of curvature differ in this case approximately by a factor of two.

The holder housing 1 has a bipartite running rail holder whose half running rail holders 10, 11 follow the ovoid outline contour, form the edge-side running rail 2 between them and are connected to one another by means of three screws 12 arranged in a distributed fashion. For this purpose, the half running rail holder 10 forms threaded bores 13 for accommodating the screws 12. In accordance with the first embodiment, each screw 12 has a central threaded cavity 14 for connecting a luminaire housing 16 to the holder housing 1 by means of three countersunk screws 15. As emerges from FIG. 6, the luminaire housing 16 is wall-mounted by a rear edge R of the running rail 2 or by the half running rail holder 10. Plastic is selected for the luminaire housing 16, while the half running rail holders 10, 11 consist of metal.

The luminaire housing 16 is a holder for a luminaire, which is configured as an incandescent lamp 17 and points in the direction of the apex A' with the largest radius of curvature. Consequently, the incandescent lamp 17 extends in the longitudinal extent of the holder housing 1. For the purpose of embedding the incandescent lamp 17, the luminaire housing 16 has a channel 18 open towards the broad side of the holder housing 16, as a result of which the half running rail holder 10 forms the contact bridge between a button cell battery K and the incandescent lamp 17. The button cell battery K is recessed in a battery accommodating compartment 16' which is opened towards the broad side of the luminaire housing 16 and, like the channel 18 as well, is arranged in the middle of the length of the luminaire housing 16. A foot contact 20 against which a compression spring 21 strikes under spring tension is provided on the incandescent lamp base 19 in an extension thereof. Said compression spring is accommodated in a spring chamber 22 plugged in a self-closed fashion into the luminaire housing 16. The compression spring 21 projects beyond the spring chamber 22 with a rectilinear end section, and forms a contact tongue 23 with the latter. Said contact tongue is supported on the inner surface of a pushbutton 24 which is formed by a thin-walled, deflectable luminaire housing section. Consequently, bridging with reliable contacting is realized even given a relatively large spacing between the burton cell battery K and incandescent lamp 17.

In order to obtain a sufficiently generous movement play for the contact tongue 23, the button cell battery K is incorporated in a sunken fashion with regard to the latter. For this purpose, the half running rail holder 10 has on its broad surface facing the luminaire housing 16 a depression 10' which is opposite the battery accommodating compartment 16' and into which the region of the button cell battery K formed by the large-surface contact 26 projects, compare FIG. 6.

Figure 6:
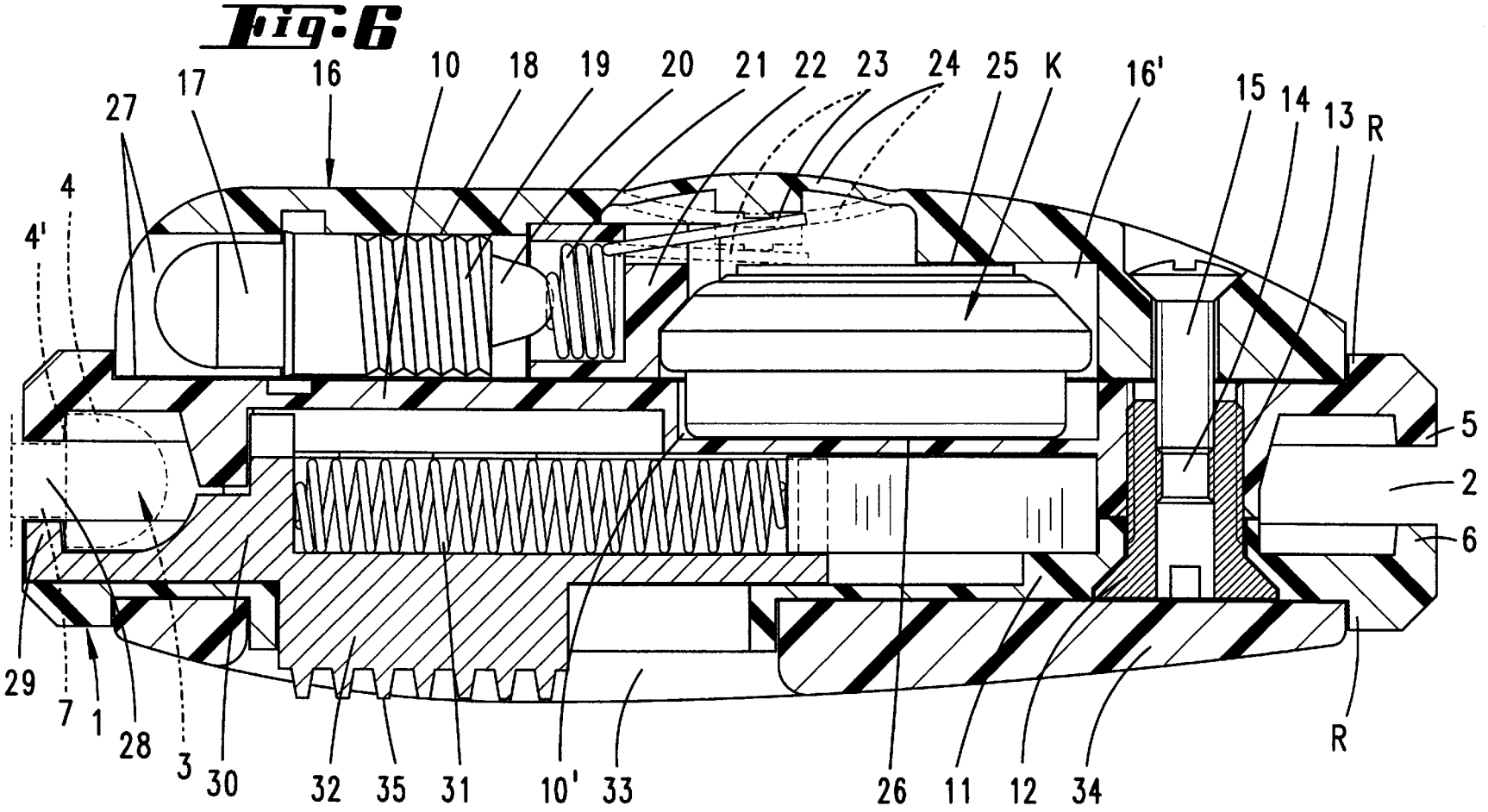
FIG. 6 shows the section along the line VI—VI in FIG. 2, greatly enlarged.
Figure 7:
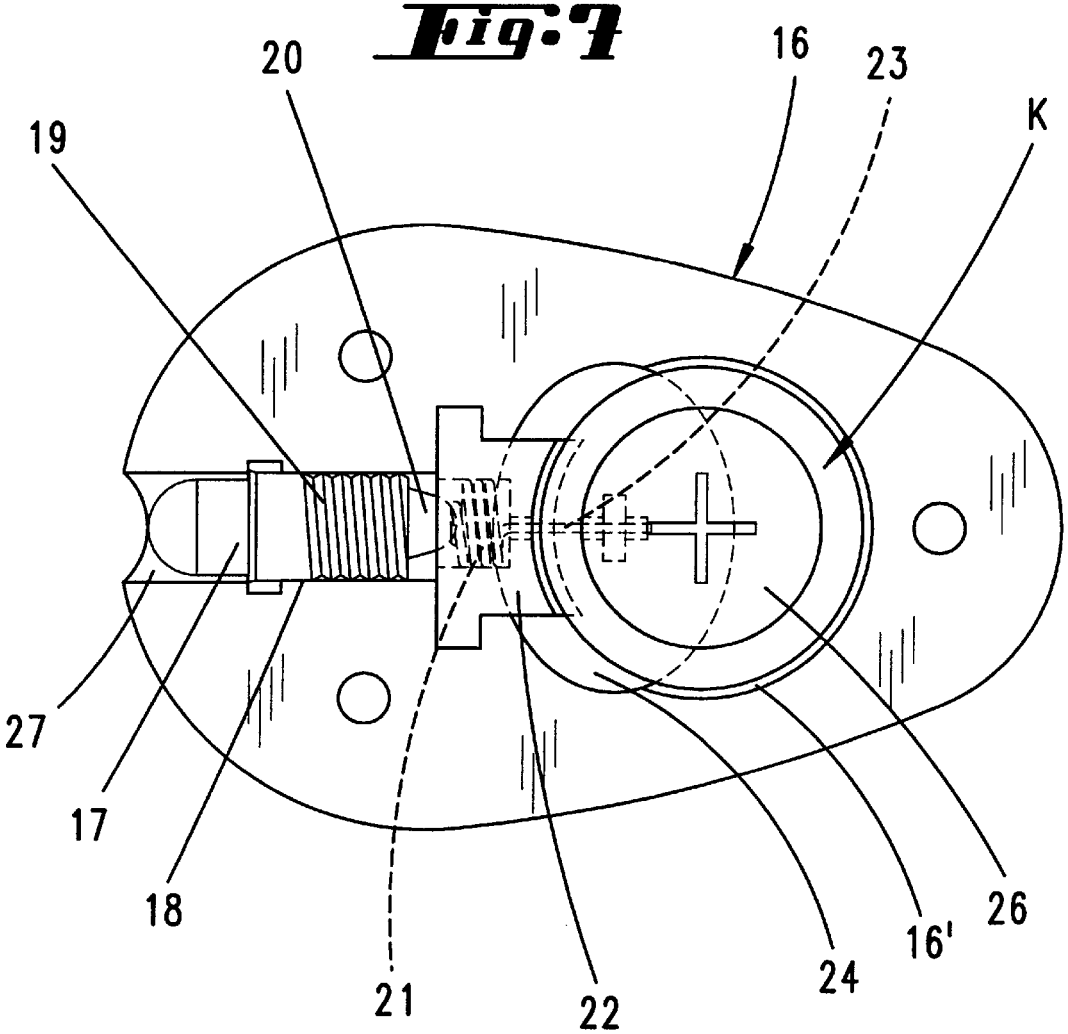
FIG. 7 shows a rear view of the luminaire housing with inserted incandescent lamp, spring compartment and button cell battery.

When pressure is applied to the pushbutton 24, the latter passes to the deflection position represented by dots and dashes in FIG. 6, the contact tongue 23 being pressed against one large-surface contact 25 of the button cell battery K. The other large-surface contact 26 of the button cell battery K is, by contrast, in conducting electric contact with the half running rail holder 10.

The beam of the incandescent lamp 17 is directed to the apex A' by means of a cylindrical stop 27. This cylinder stop 27 is formed both by the luminaire housing 16 and by the facing half running rail holder 10.

As is illustrated, in particular, by FIGS. 1, 2 and 6, the pushbutton 24 is eccentrically arranged, specifically so that it is adjacent to the apex B' with the strongest curvature.

When the circuit is closed by pressing on the pushbutton 24, the luminaire or the incandescent lamp 17 shines over the movement path of the runners 3 in the direction of the apex A'. The removal opening 28 for the runners 3 is located there. The removal opening 28 is sealed by an end section 29 of a slider 30 guided linearly in the half running rail holder 11 in the longitudinal direction of the same. The cross-sectional contour of the end section 29 follows that of the outer edge 6, with the result that with the slider 30 advanced, the running rail 2 is closed all around. The compression spring 31 arranged in the half running rail holder 11 loads the slider 30 in its closing position, which is limited by a stop. The slider 30 bears an operating grip 32 which penetrates a longitudinal cutout 33 of a broad side wall 34 assigned to the half running rail holder 11. Like the luminaire housing 16, as well, said broad side wall is wall-mounted by a rear edge of the half running rail holder 11. The longitudinal cutout 33 is dimensioned such that the slider 30 can be displaced by means of the grip 32 in such a way that the end section 29 releases the removal opening 28 and permits the runner 3 to be removed or added. In order to make the operating grip 32 more convenient to use, its working surface 35 is provided with a serration which runs transverse to the direction of displacement of the slider 30 and, in the case of a slider which has adopted its basic position, projects beyond the convexly configured broad side wall 34 by approximately half the length of the working surface 35. The remaining length extends inside the camber, compare FIG. 6. In this case, the projection of the working surface 35 faces the largest radius of curvature and extends approximately over half the height of a tooth ridge.

If a change of battery is to be undertaken, only the countersunk screws 15 need to the screwed out. Thereafter, the luminaire housing 16 can be removed, and the button cell battery K is accessible. Consequently, cohesion of the half running rail holders 10, 11 is maintained, and this makes it easy to change the battery. After the change has been carried out, the luminaire housing 16 is to be fixed again by means of the countersunk screws 15. The heads of the countersunk screws 15 lie sunk inside the luminaire housing 16 and do not form any bothersome projections on the luminaire housing 16 itself.

Figure 8:
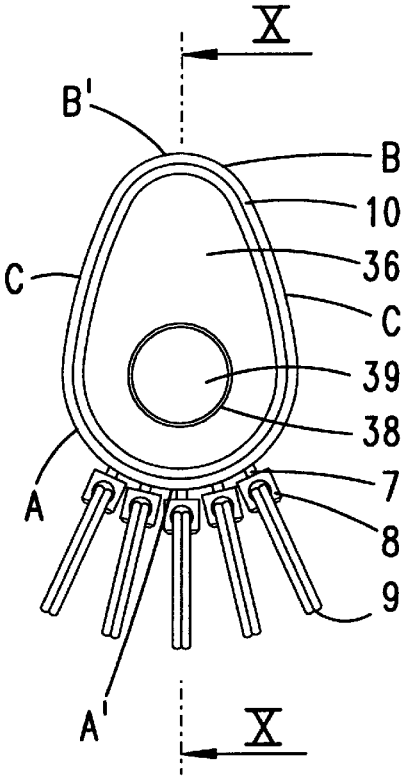
FIG. 8 shows a view of the collective holder in accordance with the second embodiment, specifically looking onto the broad side wall provided with the emblem.
Figure 9:
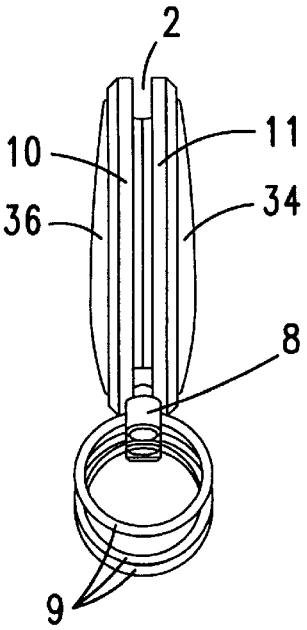
FIG. 9 shows the side view of FIG. 8.
Figure 10:
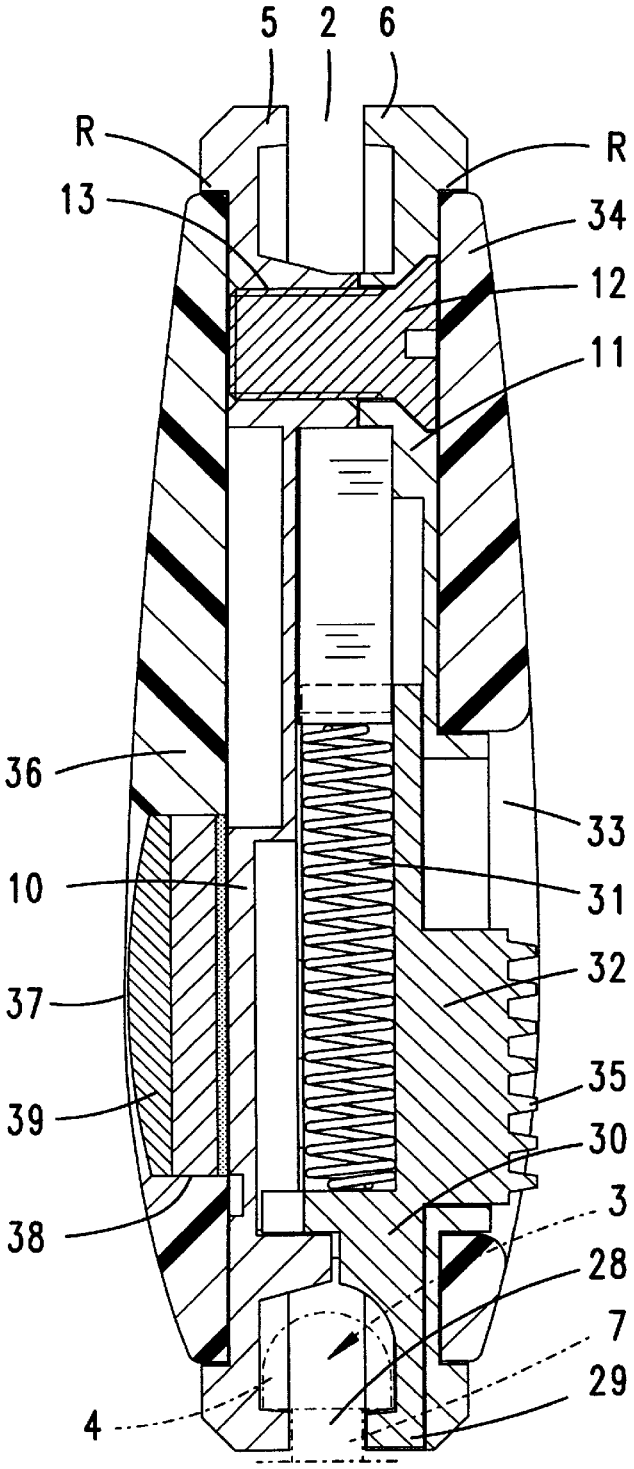
FIG. 10 shows a greatly enlarged representation of the section along the line X—X in FIG. 8.

The second embodiment illustrated in FIGS. 8 to 10 largely corresponds to the first embodiment. Identical components therefore bear identical reference symbols.

There is a difference in that instead of a luminaire housing, the half running rail holder 10 is provided with a broad side wall 36 whose plan, longitudinal section and cross section correspond to the broad side wall 34. These broad side walls 34, 36 form broad side elevations projecting beyond the running rail holder. The apex 37 of these broad side elevations extends in this case in the region of the midpoint of the arc segment A with the largest radius of curvature.

As the broad side wall 34 is penetrated by the operating grip 32, the other broad side wall 36 and the broad side elevation formed by the latter have in the region of the apex 37 a cutout 38 which has a circular plan and into which an emblem 39 is recessed. The emblem 39 is bonded to the facing broad side 3surface of the half running rail holder 10 so as also to fix the broad side wall 36 with reference to this half running rail holder 10. However, the broad side wall 36 can also be bonded to the half running rail holder 10.

I claim:

1. A collective holder, in particular for keys, having a holder housing (1) with a cornerless outline a circumferential narrow side wall of which forms a running rail (2) with a removal opening (28), operable by means of a grip from a broad side wall (34), for runners (3) captured in the running rail (2), defined by an outline contour deviating from circular and having two opposite, approximately semicircular arc segments (A, B) having apexes (A', B'), and a broad side wall of which oposite the grip (32) accommodates a luminare which points in a direction of an apex (A'), shines over a movement path of the runners (3) and is activatable by means of a pushbutton (24) arranged on the broad side wall.

2. A collective holder, in particular for keys, having a holder housing (1) with a cornerless outline a circumferential narrow side wall of which forms a running rail (2) with a removal opening (28), operable by means of a grip from a broad side wall (34), for runners (3) captured in the running rail (2), defined by an outline contour deviating from circular and having two opposite, approximately semicircular arc segments (A, B) having apexes (A',B'), and a radii of curvature of which differ from one another approximately by a factor of two, the grip (32) being situated approximately in the region of the midpoint of the arc segment (A) with the largest radius, and the removal opening (28) being situated at the apex (A') of this arc segment.

3. The collective holder as claimed in claim 1, further comprising broad side elevations which are arranged on both sides of a running rail holder and overlap the latter.

4. The collective holder as claimed in claim 3, wherein the apexes (37) of the broad side elevations are situated in the region of the midpoint of an arc segment (A) with the largest radius of curvature.

5. The collective holder as claimed in claim 3, further comprising an emblem (39) which is opposite the grip (32) and recessed in a broad side elevation.

6. The collective holder as claimed in claim 1, wherein the apexes (A', B') have radii of curvature of different size, and the outline contour has an ovoid shape.

7. The collective holder as claimed in claim 1, wherein the luminaire points in the direction of an apex (A') with the largest radius of curvature.

8. The collective holder as claimed in claim 1, wherein the removal opening (28) is situated in a region of a light beam.

9. The collective holder as claimed in claim 1, wherein the operating grip (32) is part of a slider (30).

10. The collective holder as claimed in claim 1, wherein the runners (3) have a hemispherical head (4) guided in a U-profiled running rail (2).

11. The collective holder as claimed in claim 1, wherein the luminaire is embedded in a luminaire housing (16) fastened on a broad side of the holder housing (1).

12. The collective holder as claimed in claim 11, wherein the luminaire housing (16) is connected by screws to a bipartite running rail holder, and a screwing-in thread is formed by a central threaded cavity (14) of at least one screw (12) connecting two half running rail holders (10, 11) to one another.

13. The collective holder as claimed in claim 1, wherein the pushbutton (24) is formed by a thin-walled, deflectable luminaire housing section.

14. The collective holder as claimed in claim 1, wherein a metal running rail holder forms a contact bridge between a battery (K) and incandescent lamp (17).

15. The collective holder as claimed in claim 14, further comprising a contact tongue (23) which is displaceable against a large-surface contact (25) of the battery (K) by means of the pushbutton (24).

16. The collective holder as claimed in claim 15, wherein the contact tongue (23) is an end section of a compression spring (21).

17. The collective holder as claimed in claim 1, wherein a beam of an incandescent lamp (17) is directed by means of a cylindrical stop (27).

18. The collective holder as claimed in claim 17, wherein the cylindrical stop (27) is formed both by a luminaire housing (16) and by a facing running rail holder.

19. The collective holder as claimed in claim 9, wherein the slider (30) is guided linearly.

20. The collective holder as claimed in claim 11, wherein the luminaire housing (16) is wall-mounted by a rear edge (R) of the running rail (2).

21. The collective holder as claimed in claim 1, wherein the pushbutton (24) is arranged eccentrically and adjacent to an apex (B').

22. The collective holder as claimed in claim 12, wherein on its broad surface facing the luminaire housing (16), a half running rail holder (10) has a depression (10') which is intended to partially accommodate a button cell battery (K).

23. The collective holder as claimed in claim 22, wherein the half running rail holder (10) having the depression (10') is in conductive electric connection with the luminaire and is made of metal.

24. The collective holder as claimed in claim 9, wherein the operating grip (32) of the slider (30) has a serrated working surface (35) which projects partly beyond the broad side wall (34), which runs in a convex fashion.

25. The collective holder as claimed in claim 24, wherein the projection extends approximately over half the height of a tooth ridge.

26. The collective holder as claimed in claim 2, further comprising broad side elevations which are arranged on both sides of a running rail holder and overlap the latter.

27. The collective holder as claimed in claim 26, wherein the apexes (37) of the broad side elevations are situated in the region of the midpoint of the arc segment (A) with the largest radius of curvature.

28. The collective holder as claimed in claim 2, further comprising an emblem (39) which is opposite the grip (32) and recessed in a broad side elevation.

29. The collective holder as claimed in claim 2, wherein the apexes (A', B') have radii of curvature of different size, and the outline contour has an ovoid shape.

30. The collective holder as claimed in claim 2, wherein a luminaire points in the direction of the apex (A') with the largest radius of curvature.

31. The collective holder as claimed in claim 2, wherein the removal opening (28) is situated in a region of a light beam.

32. The collective holder as claimed in claim 2, wherein the operating grip (32) is part of a slider (30).

33. The collective holder as claimed in claim 2, wherein the runners (3) have a hemispherical head (4) guided in the running rail (2) which is U-shaped.

34. The collective holder as claimed in claim 2, further comprising a luminaire embedded in a luminaire housing (16) fastened on a broad side of the holder housing (1).

35. The collective holder as claimed in claim 34, wherein the luminaire housing (16) is connected by screws to a bipartite running rail holder, and a screwing-in thread is formed by a central threaded cavity (14) of at least one screw (12) connecting two half running rail holders (10, 11) to one another.

36. The collective holder as claimed in claim 2, further comprising a pushbutton (24) formed by a thin-walled, deflectable luminaire housing section.

37. The collective holder as claimed in claim 2, wherein a metal running rail holder forms a contact bridge between a battery (K) and an incandescent lamp (17).

38. The collective holder as claimed in claim 37, further comprising a contact tongue (23) which is displaceable against a large-surface contact (25) of the battery (K) by means of a pushbutton (24).

39. The collective holder as claimed in claim 38, wherein the contact tongue (23) is an end section of a compression spring (21).

40. The collective holder as claimed in claim 37, wherein a beam of the incandescent lamp (17) is directed by means of a cylindrical stop (27).

41. The collective holder as claimed in claim 40, wherein the cylindrical stop (27) is formed both by a luminaire housing (16) and by a facing running rail holder.

42. The collective holder as claimed in claim 32, wherein the slider (30) is guided linearly.

43. The collective holder as claimed in claim 34, wherein the luminaire housing (16) is wall-mounted by a rear edge (R) of the running rail (2).

44. The collective holder as claimed in claim 36, wherein the pushbutton (24) is arranged eccentrically and adjacent to an apex (B').

45. The collective holder as claimed in claim 35, wherein on its broad surface facing the luminaire housing (16), a half running rail holder (10) has a depression (10') which is intended to partially accommodate a button cell battery (K).

46. The collective holder as claimed in claim 45, wherein the half running rail holder (10) having the depression (10') is in conductive electric connection with the luminaire and is made of metal.

47. The collective holder as claimed in claim 32, wherein the operating grip (32) of the slider (30) has a serrated working surface (35) which projects partly beyond the broad side wall (34), which runs in a convex fashion.

48. The collective holder as claimed in claim 47, wherein the projection extends approximately over half the height of a tooth ridge.

* * * * *